US007670183B2

(12) United States Patent
Huang et al.

(10) Patent No.: US 7,670,183 B2
(45) Date of Patent: Mar. 2, 2010

(54) MODULAR JACK HAVING AN IMPROVED MAGNETIC MODULE

(75) Inventors: Chao-Tung Huang, Tu-Cheng (TW); Jie Zhang, Kunshan (CN); Yong-Chun Xu, Kunshan (CN); Xiao-Hua Liu, Kunshan (CN)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 12/416,942

(22) Filed: Apr. 2, 2009

(65) Prior Publication Data

US 2009/0253300 A1 Oct. 8, 2009

(30) Foreign Application Priority Data

Apr. 2, 2008 (CN) ..... 2008 2 0034917

(51) Int. Cl.
*H01R 13/66* (2006.01)

(52) U.S. Cl. ..... 439/620.05

(58) Field of Classification Search ..... 439/620.05, 439/676, 620.17, 19, 21–25, 76.1, 541.5
See application file for complete search history.

(56) References Cited

U.S. PATENT DOCUMENTS

| | | | | |
|---|---|---|---|---|
| 5,015,204 | A | 5/1991 | Sakamoto et al. | |
| 5,069,641 | A | 12/1991 | Sakamoto et al. | |
| 5,139,442 | A | 8/1992 | Sakamoto et al. | |
| 5,736,910 | A | 4/1998 | Townsend et al. | |
| 6,102,741 | A * | 8/2000 | Boutros et al. | 439/620.06 |
| 6,811,442 | B1 * | 11/2004 | Lien et al. | 439/620.07 |

* cited by examiner

*Primary Examiner*—Javaid Nasri
(74) *Attorney, Agent, or Firm*—Ming Chieh Chang; Wei Te Chung; Andrew C. Cheng

(57) ABSTRACT

A modular jack (100) has a housing (10), a magnetic module (200) having a printed circuit board (21), a first and a second set of terminals (26, 221) mounted to the printed circuit board. The magnetic module includes a set of toroidal coil units (2) having a first core (23), a second core (24) and a third core (25), a number of first wires (233) wound around the first core and the third core, and a second wire (243) wound around the second core and the third core.

8 Claims, 5 Drawing Sheets

MODULAR JACK HAVING AN IMPROVED MAGNETIC MODULE

BACKGROUND OF THE INVENTION

1. Field of the Invention

The present invention relates to a modular jack, and more particularly to a modular jack having improved magnetic module efficiently eliminating electromagnetic interference to signal transmitted therethrough.

2. Description of Prior Arts

U.S. Pat. No. 5,736,910 issued to Townsend et al on Apr. 7, 1998 discloses a modular jack mounted onto a mother printed circuit board and adapted for receiving a plug. The modular jack includes a housing defining a receptacle, a daughter printed circuit board attached to a rear portion of the housing, a first set of contacts mounted to the housing for engaging with the plug and a second set of contacts assembled to the printed circuit board for connecting to the mother printed circuit board. A plurality of groups of toroidal coil pairs are interposed between the first contacts and the second contacts for eliminating high frequency noise. Each toroidal coil pair has a first toroidal core functioning as a common mode filter, a second toroidal core functioning as a transformer. Each toroidal coil pair has at least a coil wound around the first toroidal core and the second toroidal core for electrically connecting the first core and the second toroidal cores together.

U.S. Pat. No. 5,069,641 issued to Sakamoto et al. disclose a modular jack to be mounted on a circuit board, and the modular jack has a printed board containing a noise suppressing electronic element in a housing. The printed board is fitted with contactors for contacting with plugs and terminals to be used for mounting the modular jack on the circuit board. The contactors and the terminals are electrically connected with the noise suppressing electronic element by wires on the printed board.

In general, it need more space for locating such a large number of the toroidal coil pairs between the first and the second set of contacts, which increase the cost of manufacture.

Hence, it is desirable to provide an improved modular jack to overcome the aforementioned disadvantages.

SUMMARY OF THE INVENTION

An object of the present invention is to provide a modular jack having a magnetic module which possess little room on a daughter board.

To achieve the above object, a modular jack comprises a housing defining an opening therein, a magnetic module mounted to the housing and having a printed circuit board, a first set of terminals mounted to a front face of the printed circuit board and received in the opening, and a second set of terminals mounted to a rear face of the printed circuit board. The magnetic module comprises at least a set of toroidal coil units interposed between the first set of terminals and the second set of terminals. The toroidal coil unit has a first core, a second core and a third core, a plurality of first wires wound around the first core and the third core, and a second wire wound around the second core and the third core.

Advantages of the present invention are to provide a group of toroidal coil unit having a first core connecting with a third core by a wire to form a first circuit for eliminating high frequency noise of the first terminals and the second terminals, a second core connecting with the third core by a wire to form a second circuit for eliminating high frequency noise of the first terminals and the second terminals. Therefore, it is efficient to electrically connect the first terminals and the second terminals by a group of toroidal coil unit and reduce the cost of manufacture.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
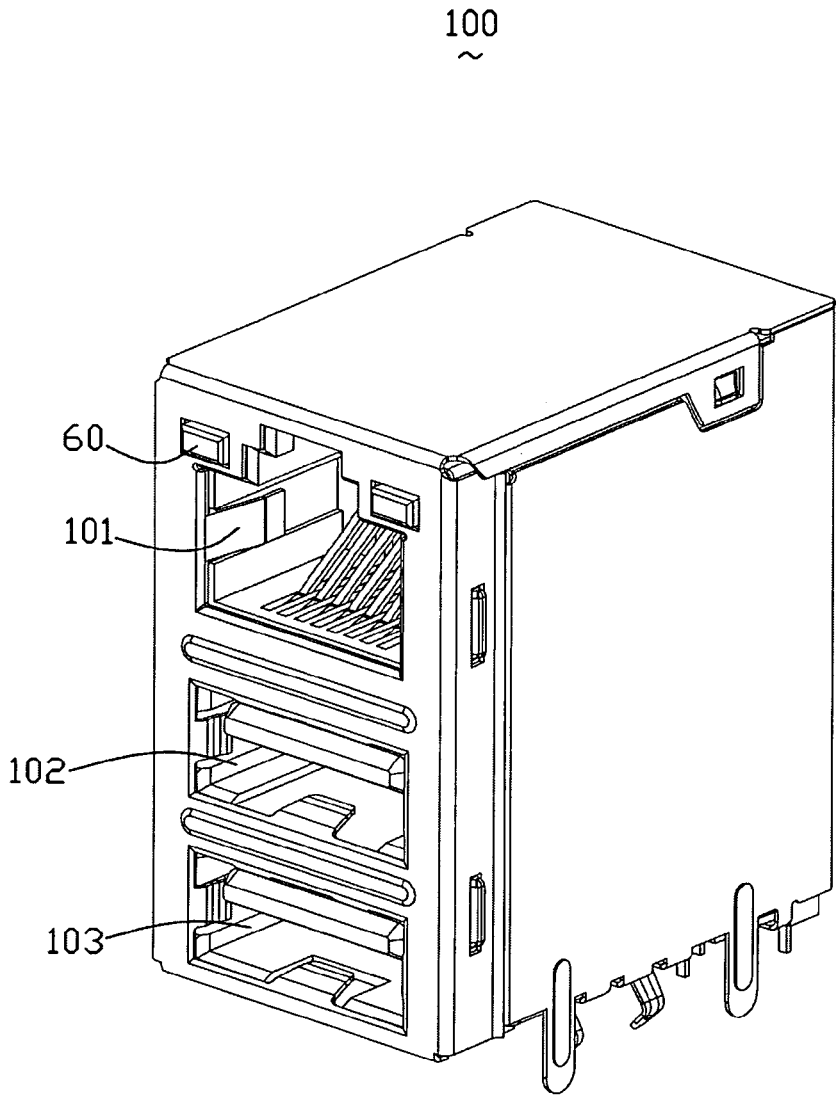
FIG. 1 is an assembled perspective view of a modular jack.
Figure 2:
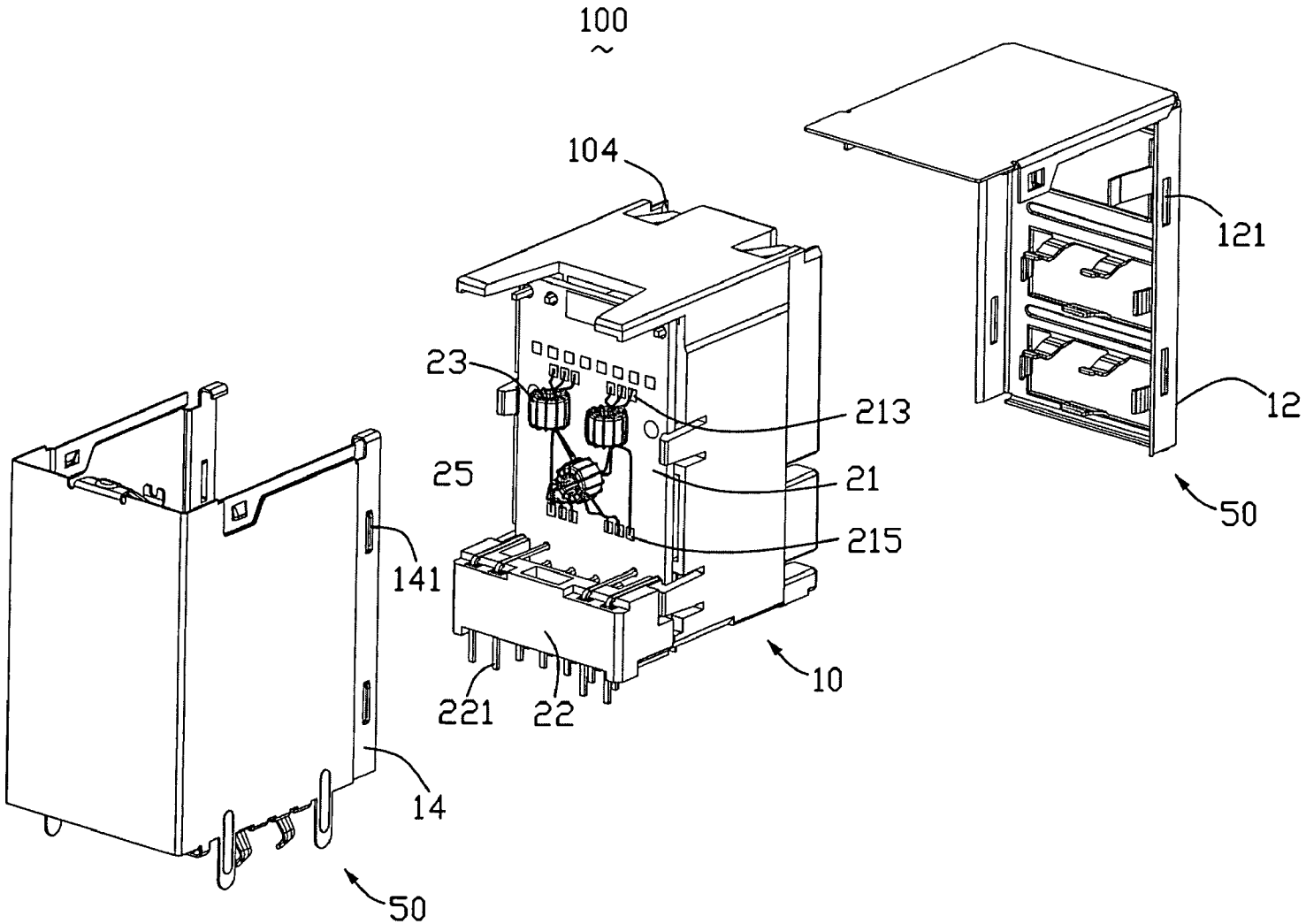
FIG. 2 is an exploded view of the modular jack as shown in FIG. 1.
Figure 3:
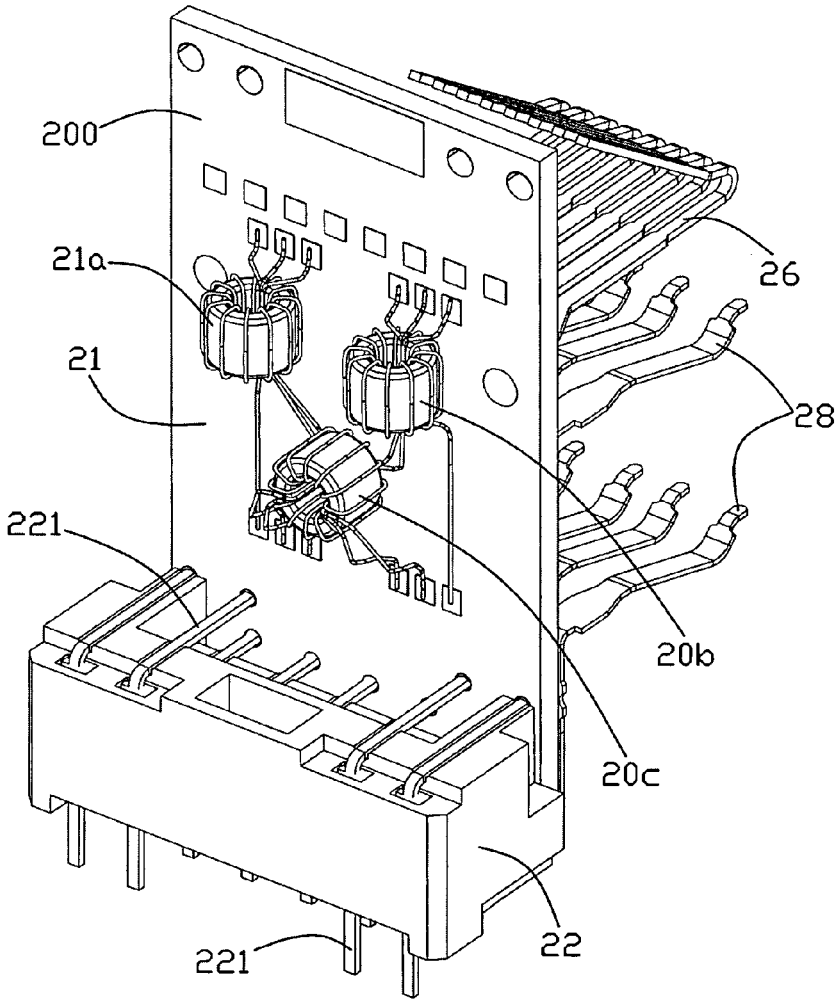
FIG. 3 is a perspective view showing a magnetic module, a plurality of first, second terminals mounted to a printed circuit board and two groups of pins assembled to the printed circuit board.

Reference will now be made to the drawing figures to describe the present invention in detail. Referring to FIGS. 1-3, a modular jack 100 is commonly used in the computer or network appliance as input/output port for transmitting data or signals. The modular jack 100 includes a housing 10 defining an opening 101 therein, a magnetic module 200 having a printed circuit board 21, and a shield 50 surrounding the housing 10.

The modular jack 100 has a first set of terminals 26 mounted to a front face of the printed circuit board 21 and received into the opening 101, a second set of terminals 221 mounted to a rear face of the printed circuit board 21 and extending downwardly for connecting with a mother printed circuit board (not shown), and two groups of pins 28 assembled to the printed circuit board 21 and paralleled to the first set of terminals 26. The modular jack 100 further comprises a pair of LEDs 60 (Light Emitting Diodes) retained in corresponding pipe slots 104 defined on a top portion of the housing 10. The housing 10 has two receiving spaces 102 and 103 defined therein and profiled one above of the other for respectively coupling with the group of pins 28.

Referring to FIGS. 2-3, the magnetic module 200 comprises a set of toroidal coil unit 2 interposed between the first terminals 26 and the second terminals 221. The toroidal coil unit 2 has a first core 23, a second core 24 and a third core 25, a plurality of first conductive wires 233 wound around the first core 23 and the third core 25 for electrically connecting the first core 23 and the third core 25 together, a plurality of second conductive wires 243 wound around the second core 24 and the third core 25 for electrically connecting the second core 24 and the third core 25 together.

Figure 4:
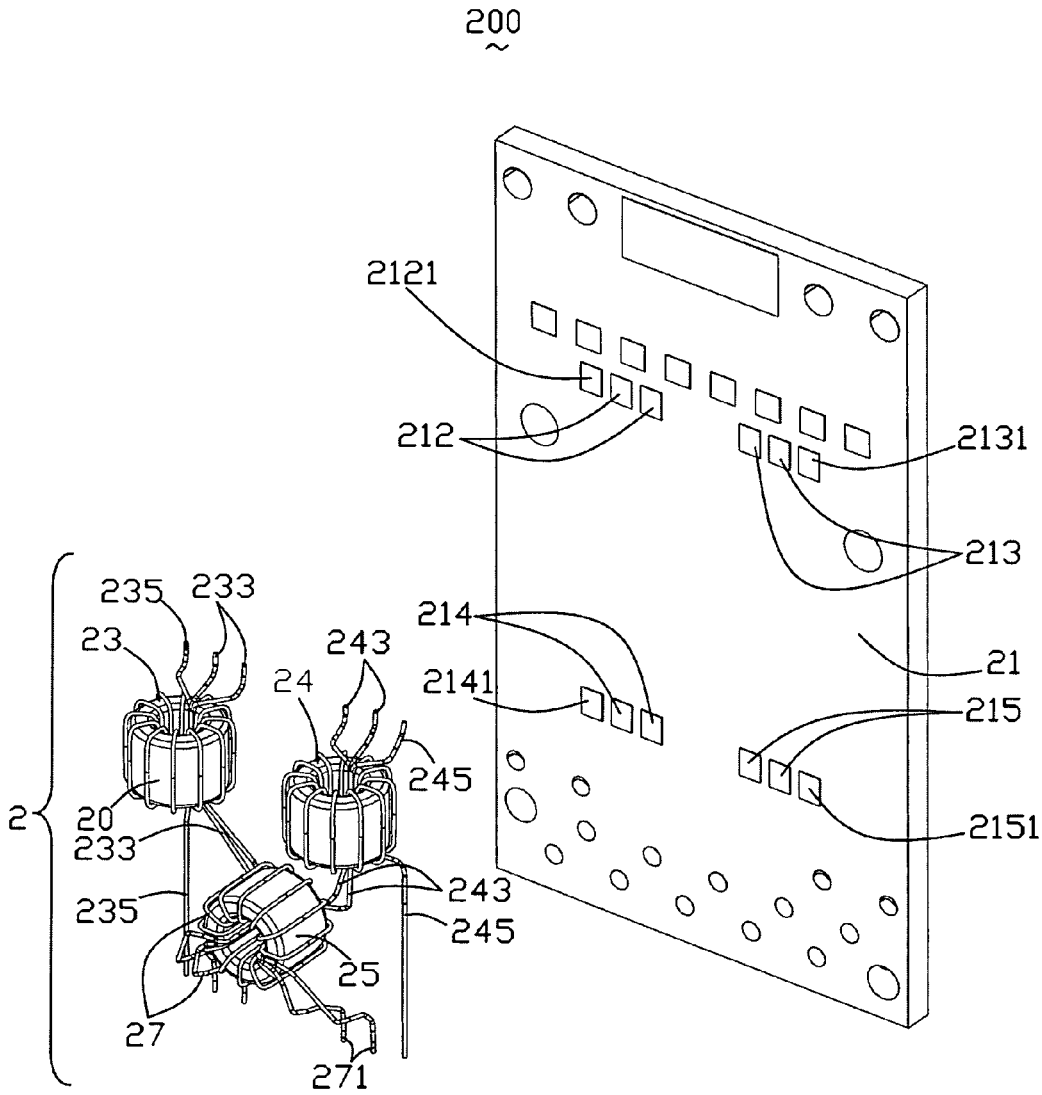
FIG. 4 is a perspective view of a magnetic module as shown in FIG. 2.
Figure 5:
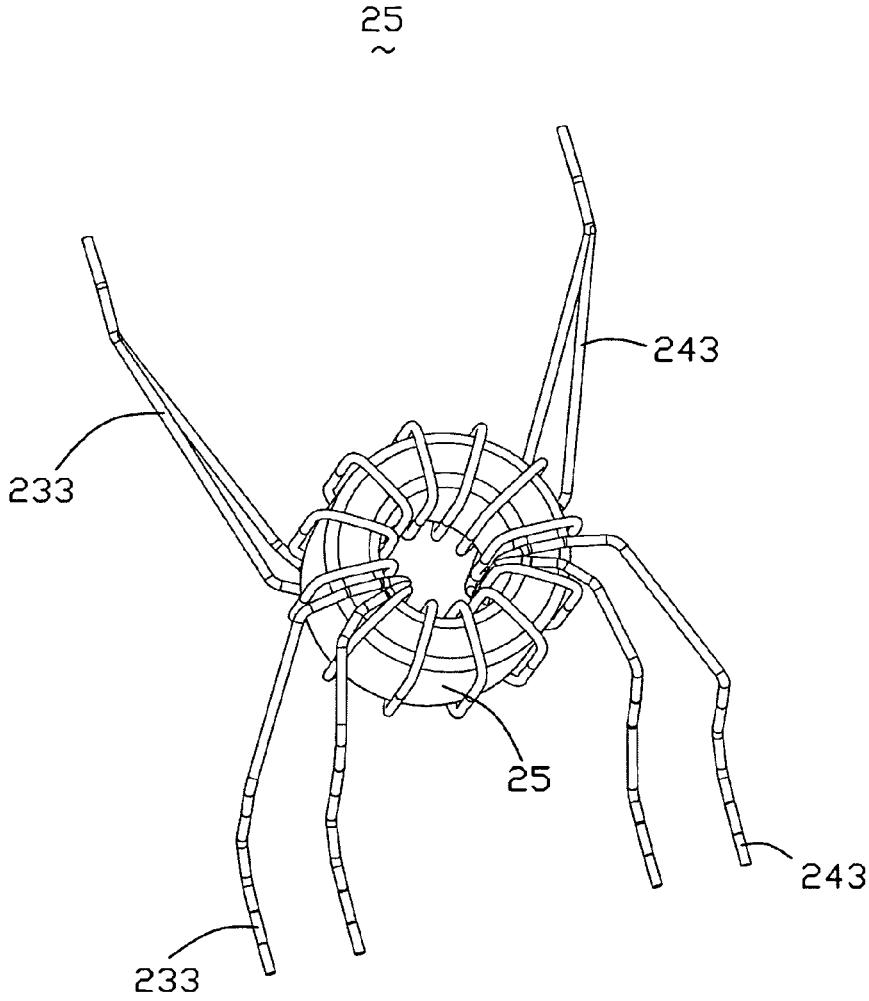
FIG. 5 is a perspective view of a third core as shown in FIG. 4.

Referring to FIGS. 3-5, the printed circuit board 21 comprises a first and second ends, first and second conductive pads 212, 213 arranged at the first end, and third and fourth conductive pads 214, 215 arranged at the second end disposed thereon. The first conductive wires 233 extends from the first conductive pad 212 and winding through the first and third magnetic cores 23 and 25, and then to the third conductive pad 214. The second conductive wires 243 extends from the second conductive pad 213 and winding through the second and third magnetic cores 24 and 25, and then to the fourth conductive pad 215. The first and the second core 23, 24 function as transformers and the third core 25 functions as a common mode filters.

The toroidal coil unit 2 comprise a first grounding wire 235 and a second grounding wire 245. The first grounding wire 235 extends from a first grounding pad 2121 and winds around the first core 23 and defines a lead connected to a third grounding pad 2141, the second grounding wire 245 extends from a second grounding pad 2131 and winds around the second core 24 and defines a second lead connected to a fourth grounding pad 2151.

Referring to FIGS. 1-2, the shield 50 comprises a front shield 12 having a number of protrusions 121 disposed on an edge portion of the front shield 12 and a rear shield 14 defining corresponding recesses 141 thereon for mating with the protrusions 121 of the front shield 12.

Referring to FIGS. 1-3, in assembling, firstly, the number of first conductive wires 233 wind around the first core 23 and one side of the third core 25, the second conductive wires 243 wind around the second core 24 and another semicircular side of the third core 25. The first wire 233 and the second wire 243 respectively wind around the third core 25 in a same direction and located in the corresponding semicircular third core 25. The ends of first and second wires 233, 243 are respectively soldered onto the row of the first and the second pads 212, 213. The opposite ends of the first and the second conductive wires 212, 213 are connected onto the third and fourth pads 214, 215. The end of first grounding wire 235 is soldered to the first grounding pad 2121, an opposite end is connected to the third grounding pad. The end of second grounding wire 245 is connected to the second grounding pad and opposite of second grounding wire 245 is soldered to the fourth grounding pad 2151. Secondly, the first set of terminals 26, the second set of terminals 221 and the two groups of pins 28 are assembled to the printed circuit board 21. Thirdly, the LEDs 60 are received into the pipe slots 104. Fourthly, the magnetic module 200 is mounted to the rear portion of the housing 10. The first set of terminals 20 and the two groups of pins 21 are respectively received into the opening 101 and the receiving spaces 102 and 103. Finally, the front shield 12 and the rear shield 14 enclose the housing 10 and are locked with each other.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A modular jack connector, comprising: an insulative housing defining a mating interface and a receiving space; a printed circuit board disposed within the receiving space, and having first and second ends, first and second conductive pads arranged at the first end, and third and fourth conductive pads arranged at the second end; first, second and third magnetic rings disposed on the printed circuit board, and the first and third magnetic rings configuring a first pair, and the second and third magnetic rings configuring a second pair; a first conductive wires extending from the first conductive pad and winding through the first and third magnetic rings, and then to the third conductive pad; and a second conductive wires extending from the second conductive pad and winding through the second and third magnetic rings, and then to the fourth conductive pad, a first grounding wire and a second grounding wire, and wherein the first grounding wire winds around the first ring and defines a lead connected to the third pad, and the second grounding wire winds around the second ring and defines a second lead connected to the fourth pad arranged at the second end; wherein said first conductive wires and the second conductive wires respectively wind around the first and third magnetic rings in a same direction.

2. The modular jack as claimed in claim 1, wherein said first magnetic rings and the second magnetic rings function as transformers, the third magnetic rings functions as a common mode filter.

3. The modular jack as claimed in claim 1, further comprising a first set of terminals mounted to a front face of the printed circuit board and electrically connecting to the first and second conductive pads and a second set of terminals mounted to a rear face of the printed circuit board and electrically connecting said third and fourth conductive pads.

4. The modular jack as claimed in claim 3, further comprising two groups of pins assembled to the printed circuit board and paralleled to the first set of terminals.

5. A modular jack, comprising: a housing defining an opening therein; a magnetic module mounted to the housing and comprising: a printed circuit board; a first, a second and a third magnetic cores; and a plurality of first wires electrically connecting with the printed circuit board and wound around the first core and the third core to configure a first pair; a plurality of second wires electrically connecting with the printed circuit board and wound around the second core and the third core to configure a second pair; a first set of terminals mounted and electrically connecting to a front face of the printed circuit board and received in the opening; and a second set of terminals mounted to a rear face of the printed circuit board and electrically connecting said first set of terminals, wherein said plurality of first wires and the second plurality of wires respectively wind around the third core in a same direction, wherein said printed circuit board comprises first and second ends, first and second conductive pads arranged at the first end, and third and fourth conductive pads arranged at the second end, the first conductive wires extends from the first conductive pad and winding through the first and third magnetic core and then to the third conductive pad, the second conductive wires extends from the second conductive pad and winding through the second and third magnetic core, and then to the fourth conductive pad, wherein said printed circuit board has a first and a second grounding pads disposed on first end, and a third and a fourth grounding pads disposed on the second end, wherein the first grounding wire winds around the first core and defines a lead connected to the first grounding pad and opposite lead connected to third grounding pad, and the second grounding wire winds around the second core and defines a second lead connected to second grounding pad and opposite second lead connected to fourth grounding pad.

6. The modular jack as claimed in claim 5, wherein said first core and the second core function as transformers, the third core functions as a common mode filter.

7. The modular jack as claimed in claim 5, further comprising two groups of pins assembled to the printed circuit board and paralleled to the first set of terminals.

8. The modular jack as claimed in claim 7, wherein said housing has two receiving spaces defined therein and profiled one above the other for respectively receiving the groups of pins.

* * * * *